United States Patent [19]

Morrison

[11] Patent Number: 4,650,366

[45] Date of Patent: Mar. 17, 1987

[54] PORTABLE SCREED

[76] Inventor: Donald R. Morrison, 6228 Eagle Peak Dr., Charlotte, N.C. 28214

[21] Appl. No.: 888,522

[22] Filed: Jul. 23, 1986

[51] Int. Cl.[4] ..... E01C 19/40

[52] U.S. Cl. ..... 404/114; 404/119; 425/456

[58] Field of Search ..... 404/97, 102, 113, 114, 404/118, 119; 425/456, 458

[56] References Cited

U.S. PATENT DOCUMENTS

| | | | |
|---|---|---|---|
| 2,314,985 | 3/1943 | Jackson | 404/114 |
| 2,542,979 | 2/1951 | Barnes | 404/114 |
| 2,584,459 | 2/1952 | Jackson | 404/114 |
| 2,651,980 | 9/1953 | Wells et al. | 404/113 |
| 2,693,136 | 11/1954 | Barnes | 404/114 |
| 3,095,789 | 7/1963 | Melvin et al. | 404/114 |
| 4,030,873 | 6/1977 | Morrison | 404/114 X |
| 4,105,355 | 8/1978 | King et al. | 404/114 |
| 4,340,351 | 7/1982 | Owens | 404/118 X |
| 4,386,901 | 6/1983 | Morrison | 404/118 X |
| 4,431,336 | 2/1984 | Nightengale et al. | 404/114 X |

*Primary Examiner*—Stephen J. Novosad
*Assistant Examiner*—John F. Letchford
*Attorney, Agent, or Firm*—B. B. Olive

[57] ABSTRACT

A lightweight and portable screed utilizes an extruded beam element as the principal structural element. The extruded beam element provides a mounting surface for both a handle and a gasoline engine, a housing for a vibrating shaft driven by the engine, a screed surface vibrated by the shaft and support surfaces for supporting the ends of the screed on forms.

5 Claims, 7 Drawing Figures

PORTABLE SCREED

TECHNICAL FIELD

The invention relates to concrete screeding apparatus and particularly to portable vibrating concrete screeds for screeding relatively narrow width wet concrete confined by forms such as for sidewalks, patio sections, and the like.

BACKGROUND ART

Applicant's prior U.S. Pat. No. 4,386,901 makes reference to useful background art and a loose bearing mounted vibrating shaft supported within an elongated open frame. Such patent was directed to a highly maneuverable screed particularly for use with so-called wet or "mud" type screeding in which forms are not available or used. With a continuing and substantial increase in residential, institutional and business construction there remains a need for a portable vibrating concrete screed of extremely light weight, of simple construction, of low cost and for use on relatively small jobs for screeding wet concrete confined by forms.

The present invention is to a great extent based upon use of a unique extruded member. This unique extrusion by itself and without added structure provides an enclosed vibrating shaft bearing mount and housing, screed surfaces, surfaces for slidably supporting the screed on forms, an engine mounting and a handle mounting surface.

Reference is next made to prior art screeds having some form of extrusion as a structural element. In this regard, U.S. Pat. No. 2,542,979 illustrates a structural T-beam mounting and welded to a separate cylindrical pipe. The T-beam provides screed surfaces. Auxiliary structure appended to the fabricated pipe/T-beam is required for mounting an electrically driven vibrator and for supporting the screed on forms. U.S. Pat. No. 2,693,136 illustrates a similar fabricated pipe/T-beam with an auxiliary structure for mounting a gasoline engine driven vibrator. U.S. Pat. No. 3,095,789 in a further example incorporates a fabricated hollow beam with auxiliary structure on which magnetic vibrators are mounted. In a further example found in U.S. Pat. No. 4,105,355 a fabricated hollow beam mounts within the beam a vibrating shaft with eccentric weights. The base of the fabricated beam is formed with attached angle pieces for supporting the screed on forms and a central bottom cover for use as a screeding surface.

Considering all of the mentioned prior art which is believed to be typically and sufficiently representative of the prior art, it can be seen that the typical portable screed is made up by fabricating and assembling a multitude of separate parts whereas the present invention recognizes that it would be desirable from the viewpoint of reducing weight, minimizing cost and improving overall portability to reduce the number of components required. All of the cited extruded elements of the prior art have the disadvantage of requiring add-on mechanically secured or welded on parts such as angle pieces, pipes, bottom plates and the like to provide a screed surface, an engine mounting surface, handle mounting surface and means for mounting a shaft type vibration source. On the other hand as the present invention recognizes, it would be desirable to provide a screed having an extruded element formed in such a way as to be slidable on forms and to provide without requiring add-on parts a screed surface, an engine mounting surface, a handle mounting surface and a housing for supporting internally of the extruded element a vibrating shaft and its bearings.

The object of the present invention thus becomes that of providing a further improved, lightweight, highly portable screed designed for use in wet screeding with forms. A more specific object becomes that of providing a portable concrete screed utilizing a uniquely formed extruded element which serves the several functions of being a screed, providing a housing for a vibrating shaft and its bearings, providing a mounting for handles for guiding and manually propelling the screed during use and providing an engine mount. Other objects will become apparent as the description proceeds.

DISCLOSURE OF INVENTION

A lightweight and portable vibrating screed is made up of a base unit and a selected number of attached substantially longer screed extension units. Each unit incorporates an extruded member housing a vibrating shaft within the extrusion and forming a screed surface. A small gasoline engine mounts on a plate forming part of the base unit extrusion and drives the vibrating shaft. Handles are secured at selected points on selected ones of the extruded members for guiding and propelling the screed.

BEST MODE FOR CARRYING OUT THE INVENTION

Figure 1:
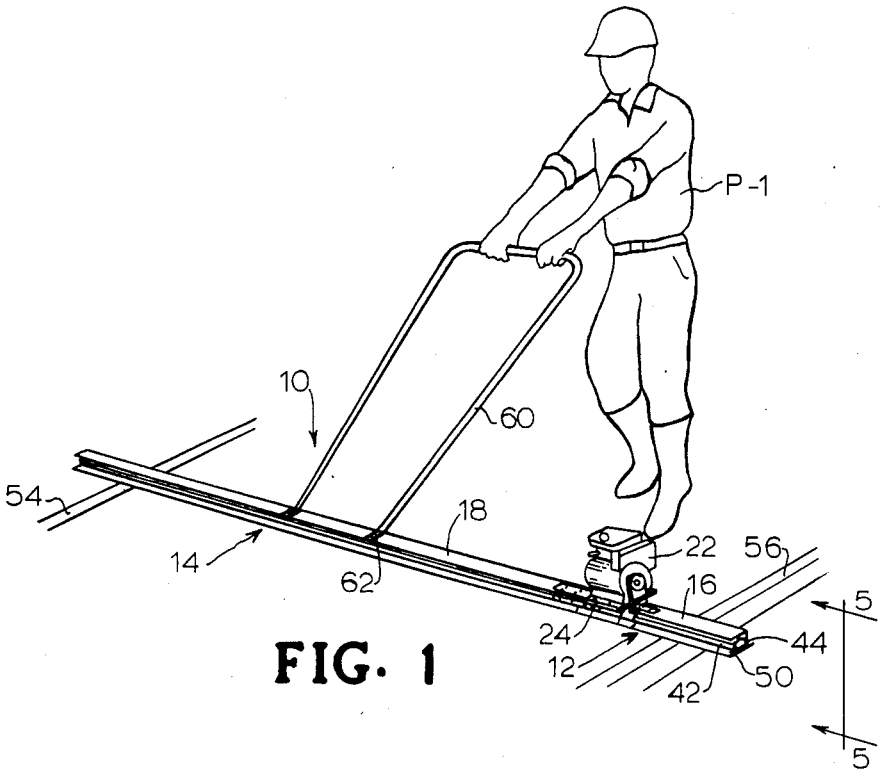
FIG. 1 is a perspective view of the invention screed illustrated in use with a single operator.

Making reference to the drawings, screed 10 of the invention according to a first embodiment illustrated in FIG. 1 comprises a base screed unit 12, typically two feet in length, and an interconnected substantially longer extension screed unit 14. The principal structural member for base unit 12 comprises a uniquely formed extruded member 16. The principal structural member for the extension of screed unit 14 comprises a similarly formed extruded member 18.

Figure 3:
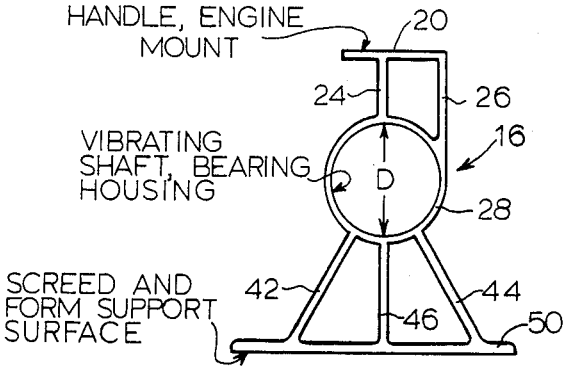
FIG. 3 is a cross sectional view of the basic extrusion used to form the screed.

Extruded members 16 and 18 are each formed with the unique cross section illustrated in FIG. 3. As indicated by such cross section, there is provided a horizontal top plate 20 which provides a mounting source for directly receiving a small gasoline engine 22 secured by bolts 24 passing through plate 20. Plate 20 is integrally formed with and supported by a center rib 24 and a back rib 26 both of which merge into an integrally extruded tubular section 28. It will, of course, be understood that plate 20, center rib 24, back rib 26 and tubular section 28 each extend for the full length of the extrusion of which they are a part.

Tubular section 28 is located and dimensioned so as to be able to directly serve as a housing for a loose bearing type vibrating shaft 34 such as previously referred to in applicant's prior U.S. Pat. No. 4,386,901. Shaft 34 is considered to comprise shaft section 34*a* in base unit 12 and shaft section 34*b* in extension unit 14. In this regard, the inside diameter D (FIG. 3) receives a series of longitudinal outer bearings 30 spaced at intervals along and within the tubular section 28. Inner sleeves 32 secured by set screws 33 fit tightly on the vibrating shaft 34 and mount bearings 30 at similar lengthwise spaced intervals but so as to purposely fit loosely within the tubular section 28. Thus, when shaft section 34*a* is driven through belt 36, pulleys 38 and 40 by engine 22, shaft 34*a* of base unit 12 and shaft 34*b* of extension unit 14 rotate and vibrate within the extruded members 16 and 18 thereby imparting vibrations to the entire screed. A stiffening bar 21 extends through belt 36 and is secured by bolts 23.

To continue the description of the extruded members 16 and 18, outwardly angled ribs 42 and 44 and vertical center ribs 46 are formed integral with and extend downwardly from tubular section 28 as best indicated in FIG. 3. A flat screed plate 50 is molded integrally with ribs 42, 44 and 46. With the previously mentioned vibrating shaft 34 in operation, screed plate 50 thus provides a flat bottom screed surface 52 for vibrating the wet concrete being screeded. It will also be observed that the ends of screed plate 52 also serve as a means for supporting screed 10 on the concrete forms 54, 56 as best illustrated in FIG. 1.

A handle 60 is secured by bolts 62 to top plate 20 for use by the single operator P-1 indicated in FIG. 1 for guiding and moving screed 10 over the wet concrete being screeded. Base screed unit 12 is connected to screed extension unit 14 by means of straps 64 secured by bolts 66,68 with the respective shaft 34*a* of base screed unit 12 being coupled to the shaft 34*b* of screed extension unit 14 by means of a shaft coupler 80 utilizing set screws 81.

Figure 2:
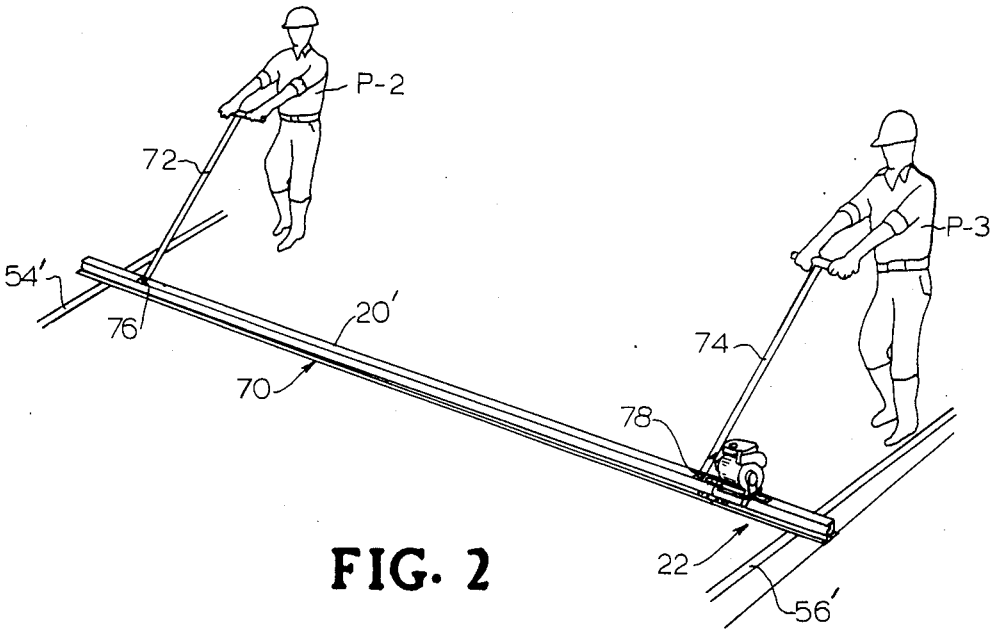
FIG. 2 is a perspective view of the invention screed illustrated in use with two operators and of substantially longer length as compared to FIG. 1.
Figure 4:
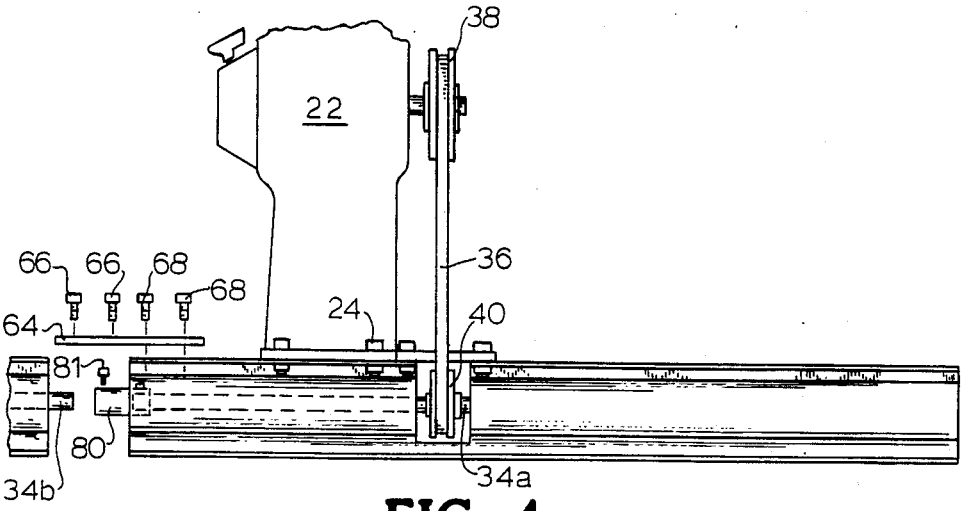
FIG. 4 is an elevation view of the base unit illustrating the shaft drive connection.
Figure 5:
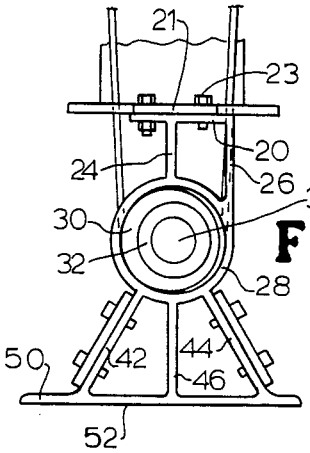
FIG. 5 is an elevation view taken in the direction of line 5—5 of FIG. 1.
Figure 6:
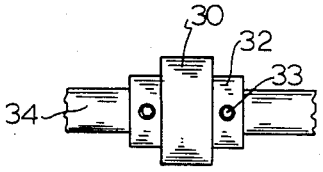
FIG. 6 is an elevation of a typical shaft-bearing section.
Figure 7:
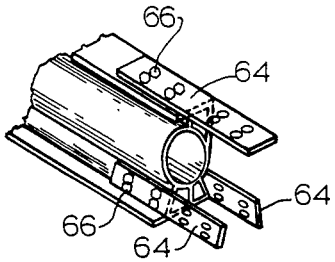
FIG. 7 is a perspective view illustrating means for securing one screed section to another.

In a second emodiment illustrated in FIG. 2, the forms 54', 56' are more widely spaced. The base unit 25 in this second embodiment is secured to a substantially longer extension screed unit 70 of a construction similar to that of extension unit 14. However, to accommodate to the longer length there is provided a pair of T-shaped handles 72, 74 secured to the top plate 20' by means of bolts 76,78 for use by a pair of operators P-2 and P-3 illustrated in FIG. 2. The construction is otherwise as previously described.

In a third embodiment, not illustrated but readily understood from the foregoing description and drawings, the base unit 12 is used without an extension unit and is long enough itself to span the width of concrete being screeded. Thus, only a single extrusion is required.

In a fourth embodiment, not illustrated but readily understood, the shaft is mounted in snugly-fitted bearings and mounts eccentric weights to establish the required vibration. Since vibrating shafts mounting eccentric weights are common, the utilization of such means of vibration with the unique extruded member of the invention will be readily understood.

What can be seen from the foregoing is that the base unit extruded element when joined to the extension screed unit extruded element effectively provides an integral extruded element extending for the full length of the screed and which without requiring auxiliary structure provides a mounting surface and support for a gasoline engine, surfaces for supporting the screed on forms, a housing for a vibrating shaft, bearing supports for the vibrating shaft, a bottom flat screed surface and surfaces suited for mounting one or more handles for guiding and moving the screed in use. Thus, the multiplicity of parts required by prior art screeds have been substantially reduced. An easily maintained, highly portable, low cost, lightweight, and easily manufactured and operated screed has been provided.

What is claimed is:

1. A concrete screed for screeding a width of concrete confined by forms comprising:

(a) an elongated extruded beam characterized by:
  (i) extending in length for the full width of the concrete to be screeded
  (ii) having a first flat horizontal plate portion on the top thereof suited for mounting directly thereon a selected number of handles and a vibrating shaft drive motor;
  (iii) having a hollow, tubular cylindrical section located below said first plate portion with the axis thereof extending parallel to said first plate portion suitable for service as a shaft housing;
  (iv) having a second flat horizontal plate portion on the bottom thereof below said tubular section and in a plane extending parallel to said first plate portion suitable for service as a screed and at the ends thereof for supporting said beam on forms;
  (v) having a first set of generally vertical ribs joining said first plate and tubular section; and
  (vi) having a second set of generally vertical ribs joining said tubular section and said second plate section;

(b) a shaft extending for the length of and housed within the said tubular section of said beam;

(c) a set of bearings mounted on said shaft and spaced at intervals along the length thereof and sized to provide a loose bearing support for said shaft within said tubular section;

(d) a motor mounted on said first horizontal plate portion and secured thereto;

(e) drive connection means between said motor and shaft enabling said motor to drive said shaft and impart vibrations to said second plate portion; and (f) at least one handle secured to said first plate portion for guiding said screed.

2. A concrete screed as claimed in claim 1 wherein:

(a) said motor comprises a gasoline engine; and (b) said connection means comprises a belt and pulley type connection extending between said motor and said shaft.

3. A concrete screed as claimed in claim 1 wherein said extruded beam is formed of a pair of interconnected rigidly secured sections one of which mounts said motor and is of a shorter length than the other, said sections forming an integral said beam.

4. A concrete screed as claimed in claim 3 wherein said handle means comprise a pair of handles located at opposite ends of said beam.

5. A concrete screed for screeding a width of concrete confined by forms comprising:

(a) an elongated extruded beam characterized by:
  (i) extending in length for the full width of the concrete to be screeded
  (ii) having a first flat horizontal plate portion on the top thereof suited for mounting directly thereon a selected number of handles and a vibrating shaft drive motor;

(iii) having a hollow, tubular cylindrical section located below said first plate portion with the axis thereof extending parallel to said first plate portion suitable for service as a shaft housing;

(iv) having a second flat horizontal plate portion on the bottom thereof below said tubular section and in a plane extending parallel to said first plate portion suitable for service as a screed and at the ends thereof for supporting said beam on forms;

(v) having a first set of generally vertical ribs joining said first plate and tubular section; and (vi) having a second set of generally vertical ribs joining said tubular section and said second plate section;

(b) a shaft extending for the length of and rotatably housed within the said tubular section of said beam;

(c) means mounted on said shaft for imparting vibrations thereto when rotated;

(d) a motor mounted on said first horizontal plate portion and secured thereto;

(e) drive connection means between said motor and shaft enabling said motor to drive said shaft and impart vibrations to said second plate portion; and (f) at least one handle secured to said first plate portion for guiding said screed.

* * * * *